US008968642B2

(12) United States Patent
Mårtensson et al.

(10) Patent No.: US 8,968,642 B2
(45) Date of Patent: Mar. 3, 2015

(54) CERMET BODY AND A METHOD OF MAKING A CERMET BODY

(75) Inventors: Malin Mårtensson, Nacka (SE); Gerold Weinl, Älvsjö (SE)

(73) Assignee: Sandvik Intellectual Property AB, Sandviken (SE)

( * ) Notice: Subject to any disclaimer, the term of this patent is extended or adjusted under 35 U.S.C. 154(b) by 43 days.

(21) Appl. No.: 13/325,086

(22) Filed: Dec. 14, 2011

(65) Prior Publication Data

US 2012/0156083 A1 Jun. 21, 2012

(30) Foreign Application Priority Data

Dec. 17, 2010 (EP) ..... 10195697

(51) Int. Cl.

| | |
|---|---|
| ***B22F 3/10*** | (2006.01) |
| ***C22C 1/05*** | (2006.01) |
| ***C22C 29/10*** | (2006.01) |
| *C22C 29/02* | (2006.01) |

(52) U.S. Cl.

CPC ..... *C22C 1/051* (2013.01); *C22C 29/10* (2013.01)

USPC ..... 419/15; 75/236

(58) Field of Classification Search

USPC ..... 419/15; 75/236

See application file for complete search history.

(56) References Cited

U.S. PATENT DOCUMENTS

| | | | | |
|---|---|---|---|---|
| 5,670,726 | A * | 9/1997 | Kolaska et al. | 75/237 |
| 7,217,390 | B2 | 5/2007 | Shim et al. | |
| 2010/0150769 | A1* | 6/2010 | Weinl et al. | 419/15 |

FOREIGN PATENT DOCUMENTS

| | | |
|---|---|---|
| CN | 100 420 762 C | 11/2006 |
| CN | 1865477 | 11/2006 |
| EP | 2 206 797 A2 | 7/2010 |

OTHER PUBLICATIONS

European Search Report for Patent Application No. 10195697.7, dated Aug. 5, 2011.

* cited by examiner

*Primary Examiner* — Rebecca Lee

(74) *Attorney, Agent, or Firm* — Morgan, Lewis & Bockius LLP

(57) ABSTRACT

A TiC-based cermet body includes TiC and WC so that the atomic ratio Ti/W is between 2 to 5, and cobalt as the binder phase is present in an amount of between 5 to 25 vol %. Further, the cermet body has at least one element from group V of the periodic table, $M_x$, so that the atomic ratio Ti/$M_x$ is between 4 to 20 and the atomic ratio W/$M_x$ is between 1 to 6. The cermet body also has Cr in an amount such that the atomic Cr/Co ratio is from 0.025 to 0.14. The cermet body includes both undissolved TiC cores with a rim of (Ti,W,$M_x$)C alloy as well as (Ti,W,$M_x$)C grains which have been formed during sintering. A method of making a cermet body is also disclosed.

8 Claims, 4 Drawing Sheets

CERMET BODY AND A METHOD OF MAKING A CERMET BODY

RELATED APPLICATION DATA

This application is based on and claims priority under 37 U.S.C. §119 to European Application No. EP 10195697.7, filed Dec. 17, 2010, the entire contents of which are incorporated herein by reference.

FIELD OF THE DISCLOSURE

The present disclosure relates to a TiC-based cermet body with an increased hardness and an increased resistance against plastic deformation. The present disclosure also relates to a method of making such cermet body.

BACKGROUND

In the discussion that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

Sintered bodies like cutting tool inserts etc. are usually made from materials containing cemented carbides or titanium based carbides or carbonitride alloys.

Titanium based carbides or carbonitride alloys are usually called cermets and contain one or more hard constituents such as carbides or carbonitrides of, e.g., tungsten, titanium, tantalum, niobium etc. together with a binder phase, which makes it possible to achieve attractive properties with regards to hardness and toughness. Cermets are useful in many applications, for instance in metal cutting tools, in wear parts etc. The properties can be adapted for a certain application by changing composition and grain size. The sintered bodies are made by techniques common in powder metallurgy like milling, granulation, compaction and sintering. The binder phase in cermets is usually Co, Fe or Ni or mixtures thereof.

The first cermet materials developed were TiC-based. In the eighties carbonitride-based cermets were introduced and a large part of the cermet materials developed since then are carbonitride-based.

For conventional cemented carbide, i.e., WC—Co based, fine grained particles after sintering can be obtained by adding chromium. However, when adding chromium to a carbonitride based cermet, no or little effect on the grain size can be seen.

CN 1865477 A discloses a guide roll, spool or valve seat of a TiC—WC based alloy comprising 30-60 wt % TiC, 15-55 wt % WC, 0-3 wt % Ta, 0-3 wt % Cr and 10-30 wt % of a binder phase being Co and Ni.

U.S. Pat. No. 7,217,390 describes a method of making an ultra-fine TiC-based cermet by mechano-chemical synthesis, e.g., high-energy ball-milling of powders of Ti, transition metal (M), Co and/or Ni powders and carbon powders. Alternatively the Ti and transition metals can be added as carbides. The transition metal, M, can be at least one element of Mo, W, Nb, V or Cr. The high-energy ball-milling will form (Ti,M)C.

However, the high-energy ball-milling is a complicated process and it would be beneficial to be able to provide a fine-grained TiC-based cermet using conventional techniques.

In conventional TiC-based cermets, a large amount of the TiC has been dissolved and new Ti—W—C grains have been formed, which leads to uncontrolled Ti—W—C grain growth and uneven grain size and deterioration of properties like hardness.

Group V elements such as Nb, Ta and V and carbides thereof, are known as grain growth inhibitors for cemented carbides. However, adding e.g. NbC to Ti(C,N) based cermets does not decrease the grain size because the amount of TiN in the alloy is the dominating parameter in these alloys. Adding group V elements such as Nb, Ta and V and carbides thereof to these cermets increases the formation of softer rims surrounding the Ti(C,N) grains, resulting in a detrimental decrease of the hardness.

Adding carbides of group V elements, e.g., NbC, to cermets results in an increase in hot hardness and improvement of plastic deformation at higher cutting temperatures, however it also decreases wear resistance at lower cutting temperatures.

By the present disclosure, however, the total grain size is decreased by nucleating new cores (and rims with the same composition as the new cores) with smaller grain size than in the starting material, keeping the hardness unchanged.

SUMMARY

It is an object of the present disclosure to provide a sintered cermet body having an improved resistance against plastic deformation.

It is yet a further object of the present invention to provide a sintered cermet body having a small grain size and a more narrow grain size distribution of the $(Ti,W,M_x)C$ grains (where $M_x$ is a group V element).

It is yet a further object of the present invention to provide a method of making a sintered cermet body with the benefits as disclosed above.

It is yet a further object of the present invention to provide a sintered cermet that comprises Nb without a decrease in hardness at maintained binder phase content It has now been found that the benefits above can be obtained by providing a TiC-based cermet body comprising Cr, and at least one element from group V of the periodic table, and having a structure with un-dissolved TiC cores, and nucleated grains of $(Ti,W,M_x)C$ alloy where $M_x$, is one or more of V, Nb or Ta. The total grain size is decreased by nucleating new cores (and rims with the same composition as the new cores) with smaller grain size than the starting material, keeping the hardness unchanged.

An exemplary embodiment of a cermet body comprises TiC and WC, cobalt as a binder phase in an amount of between 5 to 25 vol %, at least one element from group V of the periodic table, $M_x$, and Cr, wherein an atomic ratio Ti/W is between 2 to 5, wherein an atomic ratio $Ti/M_x$ is between 4 to 20 and an atomic ratio $W/M_x$ is between 1 to 6, and wherein an atomic ratio Cr/Co is from 0.025 to 0.14.

An exemplary embodiment of a method of making a cermet body comprises the steps of forming a powder mixture, subjecting the powder mixture to milling and granulation, and pressing and sintering to form a cermet body, wherein the powder mixture comprises: TiC and WC, wherein an atomic ratio Ti:W is between 2 to 5, carbides of at least one element of group V of the periodic table, $M_x$, so that an atomic ratio $Ti/M_x$ is between 4 to 20 and an atomic ratio $W/M_x$ is between 1 to 6, cobalt as a binder phase in an amount of between 5 to 25 vol % of the cermet body after sintering, and Cr, wherein an atomic ratio Cr/Co is from 0.025 to 0.14.

BRIEF DESCRIPTION OF THE DRAWING

The following detailed description of preferred embodiments can be read in connection with the accompanying drawings in which like numerals designate like elements and in which.

DETAILED DESCRIPTION

Figure 1:
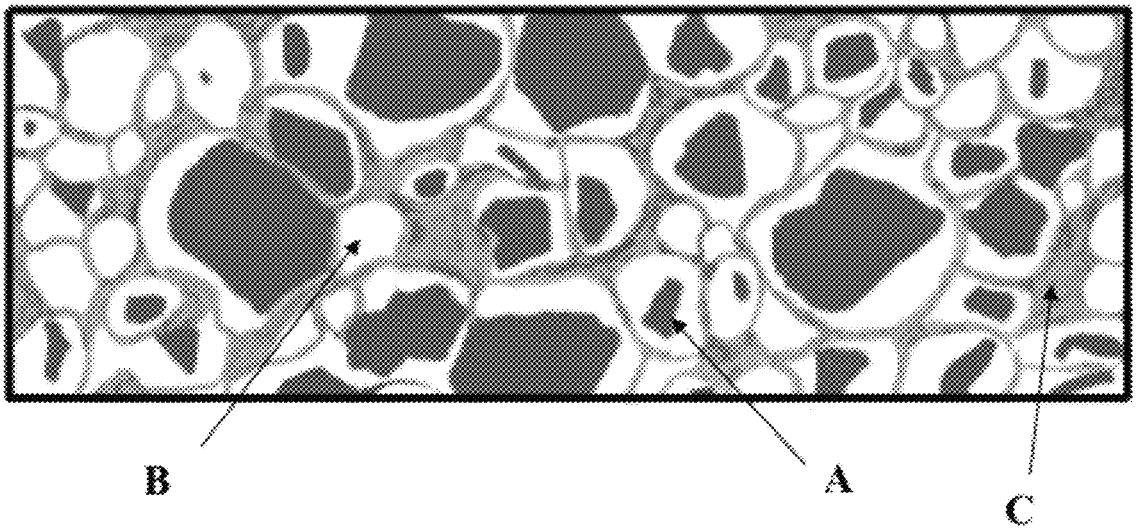
FIG. 1 show a schematic picture of the microstructure of a sintered sample according to the invention. Black areas (A) represent undissolved TiC cores with surrounding rims, white areas (B), represent newly formed $(Ti,W,M_x)C$ grains and dark grey areas (C) represent the binder phase Co(Cr).
Figure 2:
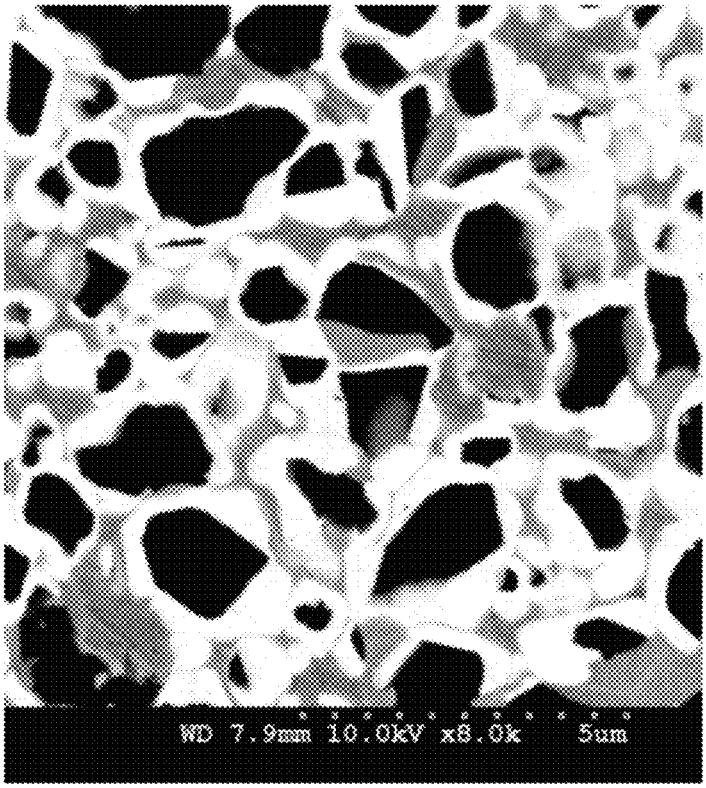
FIG. 2 show a backscatter SEM-image of microstructure consistent with that of Inv. 1 in Example 1. Black areas represent undissolved TiC cores, white areas represent newly formed $(Ti,W,M_x)C$ grains and dark grey area represent the binder phase Co(Cr).
Figure 3:
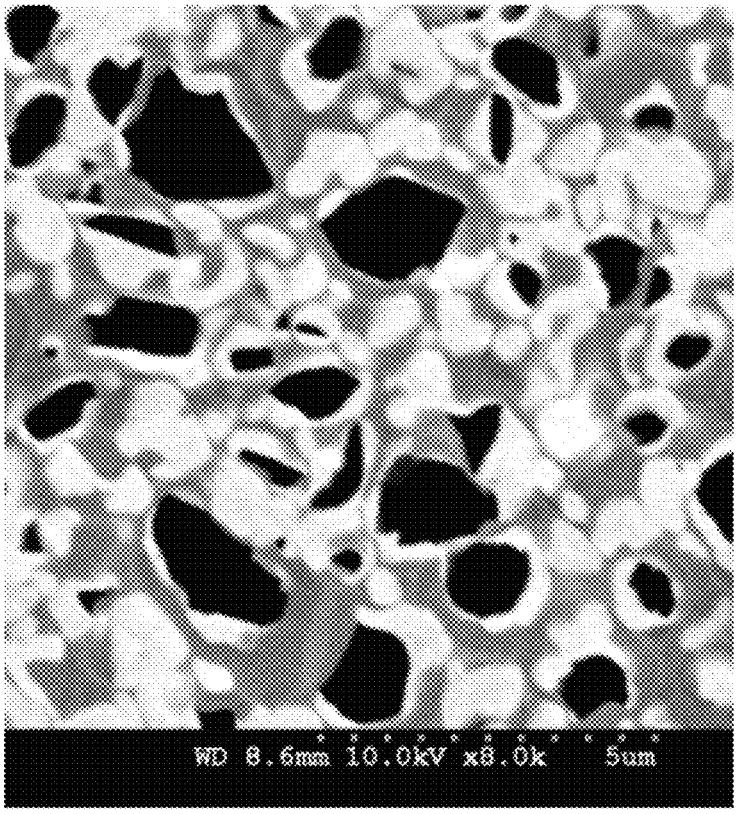
FIG. 3 show a backscatter SEM-image of microstructure consistent with that of Inv. 4 in Example 1. Black areas represent undissolved TiC cores, white areas represent newly formed $(Ti,W,M_x)C$ grains and dark grey area represent the binder phase Co(Cr).
Figure 4:
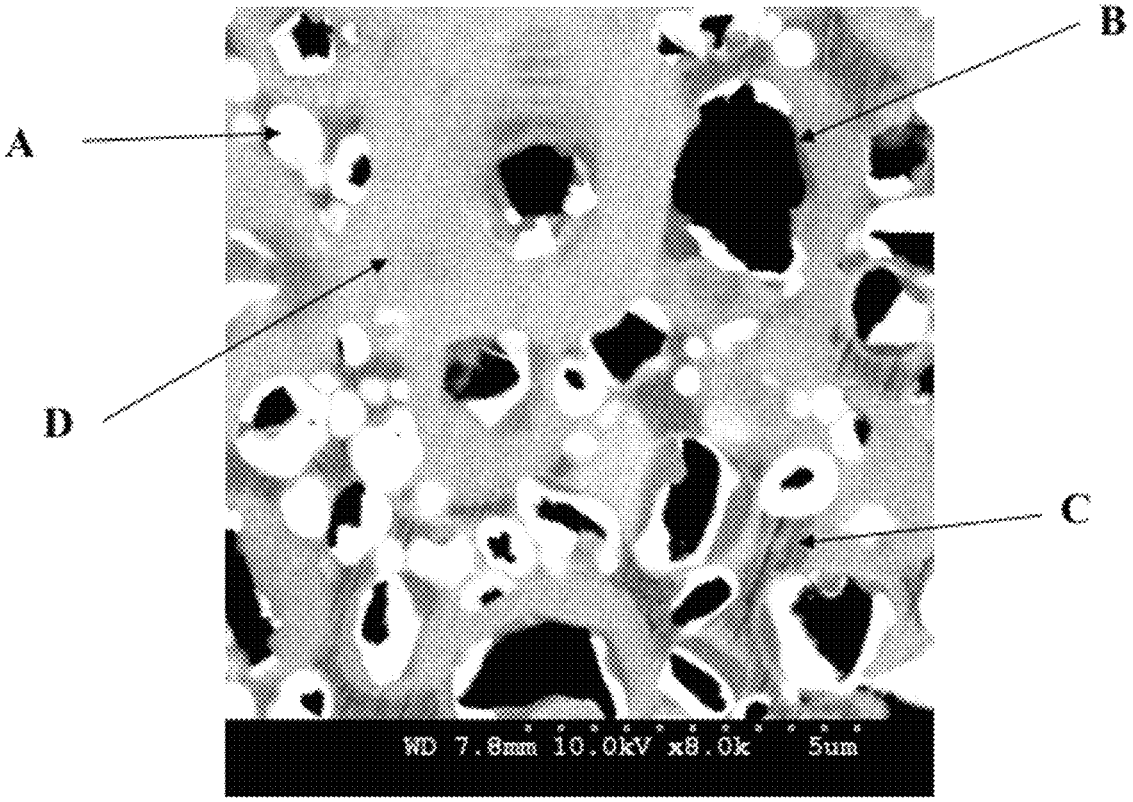
FIG. 4 show a backscatter SEM-image of the microstructure of Ref. 1 in Example 2. Black areas (B) represent undissolved TiC cores. Two different kind of newly formed (Ti, W)C grains can be seen, one with higher W-content like white areas (A) and one with lower W-content seen as large light grey regions (D) and the Co-binder phase is shown as dark grey areas (C).
Figure 5:
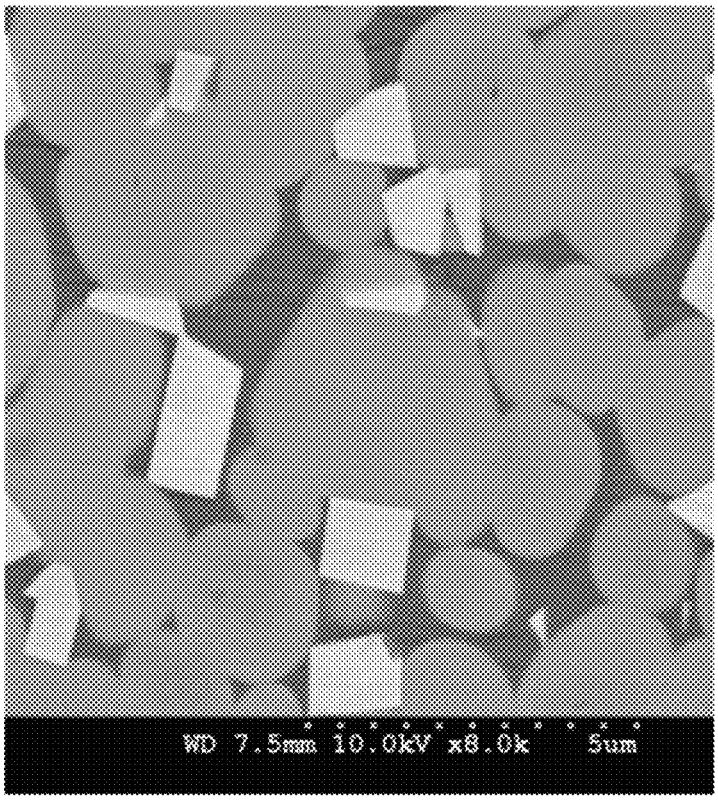
FIG. 5 show a backscatter SEM-image of the microstructure of Ref. 3 in Example 2. Grey-brownish areas represent newly formed (Ti,W,Ta,Nb)C grains, white areas represent hexagonal WC grains and dark grey areas represent the Co-binder phase.

The present disclosure relates to a cermet body which comprises TiC and WC so that the atomic ratio Ti/W is between 2 to 5, and cobalt as binder phase in an amount of between 5 to 25 vol %. The cermet further comprises at least one element from group V of the periodic table, i.e., M1, M2 and M3 where M1+M2+M3 is $M_x$, so that atomic ratio $Ti/M_x$ is between 4 to 20 and the atomic ratio W/Mx is between 1 to 6. The cermet body further comprises Cr in an amount such that the atomic ratio Cr/Co is from 0.025 to 0.14.

The cermet body is essentially free from nitrogen. By that is meant that the cermet body is made from carbides, i.e., no nitrogen containing raw materials have been used. However, small amounts of nitrogen can be present, either from impurities or as a residue from sintering processes using nitrogen gas. Preferably, the cermet body comprises less than 0.2 wt % of nitrogen.

In one embodiment of the present invention, the cermet comprises TiC and WC so that the atomic ratio Ti/W is preferably between 3 to 4.

In one embodiment of the present invention, the cermet comprises at least one element from group V of the periodic table, named $M_x$, so that atomic ratio $Ti/M_x$ is preferably between 5 to 18.

In one embodiment of the present invention, the atomic ratio $W/M_x$ is preferably between 1.5 and 5.

In one embodiment of the present invention, the at least one element from group V of the periodic table, $M_x$, is suitably one or more of V, Nb and Ta, preferably Nb and Ta, most preferably Nb.

In one embodiment of the present invention, the binder phase is Co, preferably present in an amount of 7 to 20 vol %, more preferably 8 to 18 vol %.

The amount of chromium in the cermet body according to the present invention is dependent on the ability of the Co metal to dissolve chromium. The maximum amount of Cr is therefore dependent on the Co content. The Cr/Co atom ratio is suitably from 0.025 to 0.14, preferably from 0.035 to 0.09. If chromium is added in amounts exceeding those according to the present invention, it is possible that not all chromium will dissolve into the Co binder phase but instead precipitate as undesired separate chromium containing phases, e.g., as chromium carbides or mixed chromium containing carbides.

The cermet body comprises both undissolved TiC cores with a rim of $(Ti,W,M_x)C$ alloy as well as $(Ti,W,M_x)C$ grains which have been formed during sintering. The undissolved TiC cores are the same as those originating from the TiC grains added as raw material.

The rim of $(Ti,W,M_x)C$ alloy and the newly formed $(Ti,W,M_x)C$ grains has essentially the same composition.

The newly formed $(Ti,W,M_x)C$ grains have no rims. The cermet body according to the present invention is also substantially free from precipitated hexagonal WC. By substantially free from precipitated hexagonal WC is herein meant that no hexagonal WC peaks can be found by X-ray diffraction and that no WC grains can be seen in a SEM-picture.

The ratio Q is defined as the ratio between the number of TiC cores and the number of newly formed $(Ti,W,M_x)C$ grains measured in the same area. The area is minimum 150 $\mu m^2$, preferably from a SEM image.

Q is suitably less than 6, preferably less than 4 and most preferably less than 3, but more than 0.1.

The average grain size of the TiC cores is approximated by measuring the average length of the TiC cores in a backscatter SEM-picture of a polished cross section.

The average length of the TiC cores after sintering to full density is determined by measuring the length of each TiC core, $L_{TiCn}$, where n=1, 2, . . . , n, along at least 10 lines in the backscatter SEM-picture. The average length of the TiC cores is then calculated as $\Sigma L_{TiCn}/n$.

The average grain size of the newly formed $(Ti,W,M_x)C$ grains are measured in the same way as the average grain size of the TiC-cores.

The new $(Ti,W,M_x)C$ grains that have been formed during the sintering, suitably have an average grain size of between 0.2 and 0.8 μm, preferably between 0.35 and 0.65 μm.

The average grain size of the remaining TiC cores, as measured without the $(Ti,W,M_x)C$ rim, is suitably between 0.3 and 2 μm, preferably between 0.4 and 1.5 μm, most preferably 0.4 and 1.0 μm.

In one embodiment targeting applications where a high toughness is demanded, the cermet body comprises Nb in a Ti/Nb-ratio of 5 to 10 and W/Nb of 1 to 3.5 and Co in an amount of 10-25 vol % and then preferably has a hardness of between 1200 to 2000 HV30, preferably between 1300 to 1900 HV30 depending mainly on the Co-content and TiC-grain size in the raw material.

In one embodiment targeting applications where a high resistance towards plastic deformation is required, the cermet body comprises Nb in a Ti/Nb-ratio of 10 to 18 and W/Nb of 3.5 to 6 and Co in an amount of 5-17 vol % and then preferably has a hardness of between 1450 to 2300 HV30, preferably between 1500 to 2100 HV30 depending mainly on the Co-content and TiC-grain size in the raw material.

The cermet body can also comprise other elements common in the art of cermet making such as one or more elements of group IVa and VIa, e.g. Mo, Zr and Hf, providing that the element(s) do not substantially affect the structure as described above.

In another embodiment, the cermet body has a porosity of between A00B00 and A04B02, preferably A00B00 to A02B02.

Cermet bodies according to the present disclosure can be used as cutting tools, especially cutting tool inserts. The cermet body preferably further comprises a wear resistant coating comprising single or multiple layers of at least one carbide, nitride, carbonitride, oxide or boride of at least one element selected from Si, Al and the groups IVa, Va and VIa of the periodic table.

The present disclosure also relates to a method of making a cermet body according to the above, comprising the steps of forming a mixture of powders comprising:

- TiC and WC so that the atomic Ti:W ratio is suitably between 2 to 5,
- carbides of at least one element of group V of the periodic table, $M_x$, so that the atomic ratio $Ti/M_x$ is between 4 to 20 and the atomic ratio $W/M_x$ is between 1 to 6,
- cobalt powder so that the cobalt binder phase will constitute 5 to 25 vol % of the cermet body after sintering
- Cr in an amount so that the atomic Cr/Co ratio is suitably from 0.025 to 0.14

The powder mixture is then subjected to milling, granulation of said mixture, pressing and sintering to a cermet body according to conventional techniques.

The Co powder forming the binder phase is added in such amount so that the cobalt content in the sintered cermet preferably is 7 to 20 vol %, most preferably 8 to 18 vol %.

The amount of chromium that is added is related to the amount of cobalt such that the Cr/Co atomic ratio preferably is from 0.035 to 0.09. In one embodiment, the chromium is added as pre-alloyed with cobalt. In another embodiment, the chromium is added as $Cr_3C_2$. In a further embodiment, suitably carbides of V, Nb and Ta are added, preferably carbides of Nb and Ta, most preferably NbC.

In one embodiment, the TiC and WC is added so that the atomic ratio Ti/W is preferably between 3 to 4.

In one embodiment, the carbides of the at least one element, $M_x$, of group V of the periodic table are added in such amounts so that atomic ratio $Ti/M_x$ is preferably between 5 to 18.

In one embodiment, the carbides of the at least one element, $M_x$, of group V of the periodic table are added in such amounts so that atomic ratio $W/M_x$ is preferably between 1.5 and 5.

In one embodiment, the method can further comprise the addition of other elements common in the art of cermet making such as elements of group IVa and/or VIa, e.g. Mo, Zr or Hf, providing that the element(s) do not affect the structure as described above.

The raw material powders are milled in the presence of an organic liquid (for instance ethyl alcohol, acetone, etc) and an organic binder (for instance paraffin, polyethylene glycol, long chain fatty acids etc) in order to facilitate the subsequent granulation operation. Milling is performed preferably by the use of mills (rotating ball mills, vibrating mills, attritor mills etc).

Granulation of the milled mixture is preferably done according to known techniques, in particular spray-drying. The suspension containing the powdered materials mixed with the organic liquid and the organic binder is atomized through an appropriate nozzle in a drying tower where the small drops are instantaneously dried by a stream of hot gas, for instance in a stream of nitrogen. The formation of granules is necessary in particular for the automatic feeding of compacting tools used in the subsequent stage.

The compaction operation is preferably performed in a matrix with punches, in order to give the material the shape and dimensions as close as possible (considering the phenomenon of shrinkage) to the dimension wished for the final body. During compaction, it is important that the compaction pressure is within a suitable range, and that the local pressures within the body deviate as little as possible from the applied pressure. This is particularly of importance for complex geometries.

Sintering of the compacted bodies takes place in an inert atmosphere or in vacuum at a temperature and during a time sufficient for obtaining dense bodies with a suitable structural homogeneity. The sintering can equally be carried out at high gas pressure (hot isostatic pressing), or the sintering can be complemented by a sintering treatment under moderate gas pressure (process generally known as SINTER-HIP). Such techniques are well known in the art.

The cermet body is preferably a cutting tool, most preferably a cutting tool insert.

In one embodiment, the cermet body is coated with a wear resistant coating comprising single or multiple layers of at least one carbide, nitride, carbonitride, oxide or boride of at least one element selected from Si, Al and the groups IVa, Va and VIa of the periodic table by known PVD, CVD- or MT-CVD-techniques.

The invention is further illustrated in connection with the following examples which, however, are not intended to limit the same.

Example 1

Invention

Four TiC—WC—Co—Cr—NbC cermet bodies according to the present invention, A-D, were produced by first milling the raw materials TiC, WC, Co, Cr and NbC, in the amounts according to Table 1, in a ball mill for 50 h in ethanol/water (90/10) mixture. The suspension was spray dried and the granulated powder was pressed and sintered at 1430° C. for 180 minutes according to conventional techniques.

The TiC powder had an average grain size of 1.5 μm, the WC powder had an average grain size of 0.9 μm, the NbC powder had an average grain size of 1.6 μm, the Co powder had an average grain size of 0.5 μm and the $Cr_3C_2$ powder had an average grain size of 2 μm. All ratios given herein are atomic ratios, unless otherwise specified.

TABLE 1

| | wt % | | | | | Atomic ratio | | | |
|---|---|---|---|---|---|---|---|---|---|
| | WC | TiC | NbC | Co | $Cr_3C_2$ | Ti:W | W:Nb | Ti:Nb | Cr/Co |
| Inv. 1 | 40.3 | 43.0 | 4.56 | 11.7 | 0.57 | 3.48 | 4.73 | 16.5 | 0.048 |
| Inv. 2 | 38.8 | 41.4 | 4.39 | 14.8 | 0.71 | 3.48 | 4.74 | 16.5 | 0.047 |
| Inv. 3 | 37.6 | 40.3 | 10.1 | 11.6 | 0.57 | 3.50 | 2.0 | 7.0 | 0.048 |
| Inv. 4 | 36.2 | 38.8 | 9.70 | 14.7 | 0.70 | 3.50 | 2.0 | 7.0 | 0.046 |

Example 2

Prior Art

Three cermet bodies according to prior art was also prepared by first milling the raw materials TiC, WC, Co, $Cr_3C_2$, NbC and TaC in the amounts as given in weight % in Table 3, in a ball mill for 50 h in ethanol/water (90/10) mixture. The suspension was spray dried and the granulated powder was pressed and sintered at temperatures and sintering times as given in Table 2.

TABLE 2

| | Sintering temperature (° C.) | Sintering time (min) |
|---|---|---|
| Ref. 1 | 1510 | 90 |
| Ref. 2 | 1450 | 60 |
| Ref. 3 | 1520 | 60 |

The TiC powder had an average grain size of 1.5 μm, the WC powder had an average grain size of 0.9 μm, the NbC powder had an average grain size of 1.6 μm and the Co powder had an average grain size of 0.5 μm. All ratios given herein are atomic ratios, unless otherwise specified.

TABLE 3

| | wt % | | | | | | Atomic ratio | | | |
|---|---|---|---|---|---|---|---|---|---|---|
| | WC | TiC | Co | $Cr_3C_2$ | NbC | TaC | Ti/W | W/(Ta + Nb) | Ti/(Ta + Nb) | Cr/Co |
| Ref. 1 | 41.2 | 46.4 | 12.4 | — | — | — | 3.69 | — | — | — |
| Ref. 2 | 41.2 | 46.4 | 11.9 | 0.5 | — | — | 3.69 | — | — | 0.041 |
| Ref. 3* | 55.5 | 19.0 | 9.50 | — | 3.76 | 12.2 | 1.12 | 2.86 | 3.2 | — |

*The atomic ratio Ta:Nb is 1.77.

Example 3

Structure

SEM images of the sintered structures were analysed by using the linear intercept method as has been described earlier. The average grain size of the TiC cores (black cores in the SEM images) has been measured on the TiC cores alone without the $(Ti,W,M_x)C$ rim (white in the SEM images).

The average grain size of the newly formed (Ti,W,Mx)C grains (white cores in the SEM images) has been measured in the same way as the TiC cores. The Q is the ratio between the number of TiC cores and the number of newly formed (Ti,W, Mx)C cores.

TABLE 4

| Cermet | TiC cores Average grain size | $(Ti, W, M_x)C$ cores, Average grain size | Q | WC grains Average grain size |
|---|---|---|---|---|
| Inv. 1 | 0.6 | 0.5 | 2.3 | — |
| Inv. 2 | 0.7 | 0.5 | 2.2 | — |
| Inv. 3 | 0.6 | 0.5 | 1.3 | — |
| Inv. 4 | 0.7 | 0.5 | 0.77 | — |
| Ref. 1 | 0.9 | 0.5** | 1.4 | — |
| Ref. 2 | 0.21 | 0.6* | 8.0 | — |
| Ref. 3 | — | 1.9 | — | 1.3 |

*Newly formed (Ti, W)C grains.

**Also present a second newly formed (Ti, W)C phase with abnormal growth.

Example 4

Properties after Sintering

The porosity, hardness, K1c, HC and Com of the cermet bodies from Examples 1 and 2 were evaluated. The porosity was evaluated according to ISO standard 4505 (Hard Metals Metallografic determination of porosity and uncombined carbon).

The Vickers hardness HV30 was measured according to ISO standard 3878 (Hardmetals—Vickers hardness test) and the porosity was measured by ISO standard 4505 (Hard Metals Metallografic determination of porosity and uncombined carbon).

The coercive field strength Hc in kA/m was measured according to the standard CEI IEC 60404-7 and the specific magnetic saturation in $10^{-07}$ $Tm^3/kg$ was measured according to the standard CEI IEC 60404-14 using a Foerster Koerzimat CS 1.096 instrument. The magnetic saturation Com in % is the specific magnetic saturation of the sintered body divided by the specific magnetic saturation of pure Co ($2010\times10^{-07}$ $Tm^3/kg$) multiplied with 100. The results can be seen in Table 5 below

TABLE 5

| Cermet | Hardness (HV30) | Porosity | Hc kA/m | Com % | Density g/cm$^3$ |
|---|---|---|---|---|---|
| Inv. 1 | 1753 | A00B00C00 | 12.27 | 10.45 | 7.56 |
| Inv. 2 | 1664 | A00B00C00 | 11.58 | 13.21 | 7.60 |
| Inv. 3 | 1761 | A00B00C00 | 13.49 | 10.40 | 7.58 |
| Inv. 4 | 1674 | A00B00C00 | 12.62 | 13.22 | 7.61 |
| Ref. 1 | 1591 | A00B02C00 | 11.83 | 10.91 | 7.51 |
| Ref. 2 | 1745 | A02B01C00 | 13.22 | 10.72 | 7.43 |
| Ref. 3 | 1545 | A02B00C00 | 10.02 | 8.90 | 10.30 |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A sintered cermet body having a microstructure comprising:

a plurality of first grains including a core of undissolved TiC and a rim of (Ti, W, $M_x$)C;

a plurality of (Ti, W, $M_x$)C grains; and a binder phase including Co(Cr), wherein the plurality of first grains and the plurality of (Ti, W, $M_x$)C grains are distributed in the binder phase, wherein an atomic ratio Ti/W is between 2 to 5 of the cermet body, wherein an amount of cobalt is between 5 to 25 vol % of the cermet body, wherein $M_x$ is at least one element from group V of the periodic table, wherein an atomic ratio Ti/$M_x$ is between 4 to 20 of the cermet body, wherein an atomic ratio W/$M_x$ is between 1 to 6 of the cermet body, wherein an atomic ratio Cr/Co is from 0.025 to 0.14 of the cermet body, and wherein the cermet body is essentially free of nitrogen.

2. The sintered cermet body according to claim 1, wherein the atomic ratio Cr/Co is from 0.035 to 0.09.

3. The sintered cermet body according to claim 1, wherein the atomic ratio Ti/$M_x$ is between 5 to 18.

4. The sintered cermet body according to claim 1, wherein the atomic ratio W/$M_x$ is between 1.5 to 5.

5. The sintered cermet body according to claim 1, wherein the atomic ratio Ti/W is between 3 to 4.

6. The sintered cermet body according to claim 1, wherein $M_x$ is Nb.

7. The sintered cermet body according to claim 1, wherein a ratio Q is less than 6, wherein the ratio Q is defined as a ratio between the number of cores of undissolved TiC and the number of (Ti, W, $M_x$)C grains measured in the same area.

8. The sintered cermet body according to claim 1, wherein the cermet body is a cutting tool insert.

* * * * *